US005341965A

United States Patent [19]

Maas et al.

[11] Patent Number: 5,341,965

[45] Date of Patent: * Aug. 30, 1994

[54] PLASTIC SPRING ASSEMBLY FOR TRIGGER SPRAYER

[75] Inventors: Wilhelmus J. J. Maas; Petrus L. W. Hurkmans, both of Someren, Netherlands

[73] Assignee: AFA Products, Forest City, N.C.

[ * ] Notice: The portion of the term of this patent subsequent to Jul. 20, 2010 has been disclaimed.

[21] Appl. No.: 91,994

[22] Filed: Jul. 14, 1993

Related U.S. Application Data

[63] Continuation of Ser. No. 840,766, Feb. 24, 1992, Pat. No. 5,228,602.

[51] Int. Cl.[5] ..... B67D 5/00

[52] U.S. Cl. ..... 222/340; 222/383; 239/333

[58] Field of Search ..... 222/207, 321, 336, 339, 222/340, 378, 380, 383, 384, 385; 239/333, 394

[56] References Cited

U.S. PATENT DOCUMENTS

| | | | |
|---|---|---|---|
| 3,768,734 | 10/1973 | Anderson, Jr. et al. | 239/333 |
| 4,153,203 | 5/1979 | Tada | 239/333 |
| 4,191,313 | 3/1980 | Blake et al. | 222/335 |
| 4,222,501 | 9/1980 | Hammett et al. | 222/207 |
| 4,241,853 | 12/1980 | Pauls et al. | 222/207 |
| 4,593,607 | 6/1986 | Bennett | 92/130 |
| 4,624,413 | 11/1986 | Corsette | 239/333 |
| 4,815,663 | 3/1989 | Tada | 239/333 |
| 4,898,307 | 2/1990 | Tiramani | 222/207 |
| 4,915,263 | 4/1990 | Corba | 222/321 |
| 5,211,315 | 5/1993 | Geier | 239/333 X |

FOREIGN PATENT DOCUMENTS

| | | | |
|---|---|---|---|
| 3314020 | 10/1984 | Fed. Rep. of Germany | 239/333 |

*Primary Examiner*—Kashnikow: Andres
*Assistant Examiner*—Anthoula Pomrening
*Attorney, Agent, or Firm*—Thomas R. Vigil

[57] ABSTRACT

The trigger operated pumping mechanism for a fluid dispensing device comprises a body extending rearwardly from a discharge end of the fluid dispensing device toward a hand gripping formation of the fluid dispensing device. The body has a hollow cylinder therein extending to a rear wall. A piston is received in the cylinder. A trigger is movably mounted to the body, has a front side and a back side, and is coupled to the piston. A biasing mechanism for biasing the trigger away from the body to bias the piston coupled to the trigger out of the cylinder is positioned between the body and the trigger. The biasing mechanism includes non-metal, non-coiled, elongate spring structure having opposite ends, extending rearwardly from the trigger toward the hand gripping formation, having one end positioned adjacent to and acting against the trigger and having another end positioned rearwardly of the trigger adjacent the body at a location which is closer to the rear wall of the cylinder than to the trigger.

5 Claims, 5 Drawing Sheets

PLASTIC SPRING ASSEMBLY FOR TRIGGER SPRAYER

This is a continuation of application Ser. No. 07/840,766 filed on Feb. 24, 1992, now U.S. Pat. No. 5,228,602.

BACKGROUND OF THE INVENTION

1. Field of the Invention.

The present invention relates to a trigger operated dispensing device, e.g. a trigger sprayer, for mounting on a storage container. The trigger sprayer includes a body, and a pumping mechanism comprising a trigger movably mounted to the body, a piston coupled to the trigger and a cylinder in the body for receiving the piston for pumping fluid and defining a pumping chamber.

The pumping mechanism operates in two working strokes: a fluid intake stroke and a fluid ejection stroke. The fluid intake stroke sucks liquid out of the container into the pumping chamber. The fluid ejection stroke discharges the fluid from the pumping chamber through a nozzle assembly of the trigger sprayer into the atmosphere. The fluid ejection stroke is carried out by the operator squeezing the trigger and the fluid intake stroke is carried out by a biasing mechanism, such as a spring or spring assembly, of the pumping mechanism.

More specifically, the present invention relates to a biasing mechanism comprising a plastic spring assembly, which is mounted outside of the pumping chamber between the trigger and the body and which acts on the trigger.

2. Description of the Related Art Including Information Disclosed Under 37 CFR 1.97-1.99

It is well known in the art of trigger sprayers to mount a metal spring in a pumping chamber of a pumping mechanism in a trigger sprayer. The spring acts against a piston coupled to the trigger for urging the trigger to its home, at rest, position when the trigger is released.

Heretofore, it has also been proposed to provide plastic springs or flexures in trigger sprayers. Some examples of these previously proposed trigger sprayers are disclosed in the following patents:

| U.S. Pat. No. | Patentee |
|---|---|
| 4,915,263 | Corba |
| 4,273,290 | Quinn |
| 4,241,853 | Pauls et al. |

In the Corba U.S. Pat. No. 4,915,263 a trigger sprayer having a plastic frame, including a trigger, an upper leg and a lower leg with a flexure therebetween and a cap, together with a pumping device, a nozzle assembly and a delivery arm is disclosed. The pumping device is mounted in the cap of the frame and a tubular extension of the pumping device is inserted through an opening of the cap to be press-fitted to the delivery arm to create a connection between the container and the nozzle assembly, mounted at the delivery arm.

The pumping device of the sprayer is mainly made out of plastic, but includes a coiled spring made out of metal to provide a return force to the frame and the trigger handle. The frame, the nozzle and the delivery arm of the trigger sprayer are molded out of plastic material. As a part of the frame of the trigger sprayer, the flexure is located between the upper and lower leg of the frame and is also made out of plastic and urges the trigger handle to its home position.

The frame, including the trigger handle, the upper and lower leg, the flexure, and the cap is molded as one piece of plastic. The flexure enables the trigger handle to be moved inwardly and downwardly. After the trigger handle is released, the plastic material of the frame, especially the flexure, is stressed and because of its plastic memory, it urges the frame, including the trigger handle, back to its home position. The returning force of the flexure is minimal and therefore Corba suggests replacing the plastic flexure by a metal flexure, if necessary.

The major returning force of this trigger sprayer is provided by the metal spring of the pumping mechanism, and the main feature of the flexure is to enable arcuate movement of the trigger handle.

The Quinn U.S. Pat. No. 4,273,290 discloses a chamber, next to a nozzle, including a plastic spring, a spin element and a poppet valve therein. The spin element, the poppet valve and the plastic spring are molded as one piece. The spring is formed as a double curved leaf spring and is forced into the chamber so that the spring is permanently compressed and therefore pushes one end of the spin element against the nozzle and the other end urges the poppet valve against an annular shoulder.

The Pauls et al. U.S. Pat. No. 4,241,853 discloses a trigger sprayer, including a one-piece molded shroud secured over the body and having a trigger return spring integrally molded therewith. This spring comprises a pair of depending, resiliently yieldable spring arms disposed in contacting alignment with spaced apart legs of the trigger. Pauls et al. does not disclose the kind of material used for the spring means and it is only speculation from the shading in the Pauls et al. patent drawings that a non-metal material is used.

The plastic spring assembly disclosed herein is significantly different from the prior Corba, Quinn and Pauls et al. biasing mechanism, such as springs and flexures.

As will be described in greater detail hereinafter, the spring assembly of the present invention is positioned between a trigger and the body of the trigger sprayer and is operable, after the operator has carried out an ejection stroke and released the trigger, to urge the trigger back to is home position. Making the spring assembly out of plastic enables the trigger sprayer to be recycled since it takes the place of a conventional metal spring in a cylinder of the pumping chamber.

SUMMARY OF THE INVENTION

According to the present invention, there is provided a trigger operated pumping mechanism for a fluid dispensing device. The trigger operated pumping mechanism comprises a body extending rearwardly from a discharge end of the fluid dispensing device rearwardly toward a hand gripping formation of the fluid dispensing device. The body has a hollow cylinder therein extending to a rear wall. A piston is received in the cylinder. A trigger is movably mounted to the body, has a front side and a back side, and is coupled to the piston. A biasing mechanism for biasing the trigger away from the body to bias the piston coupled to the trigger out of the cylinder is positioned between the body and the trigger. The biasing mechanism includes non-metal, non-coiled, elongate spring structure having opposite ends, extending rearwardly from the trigger toward the hand gripping formation, having one end positioned adjacent to and acting against the trigger and having another end positioned rearwardly of the trigger adjacent the body at a location which is closer to the rear wall of the cylinder than to the trigger.

DESCRIPTION OF THE PREFERRED EMBODIMENT(S)

Figure 1:
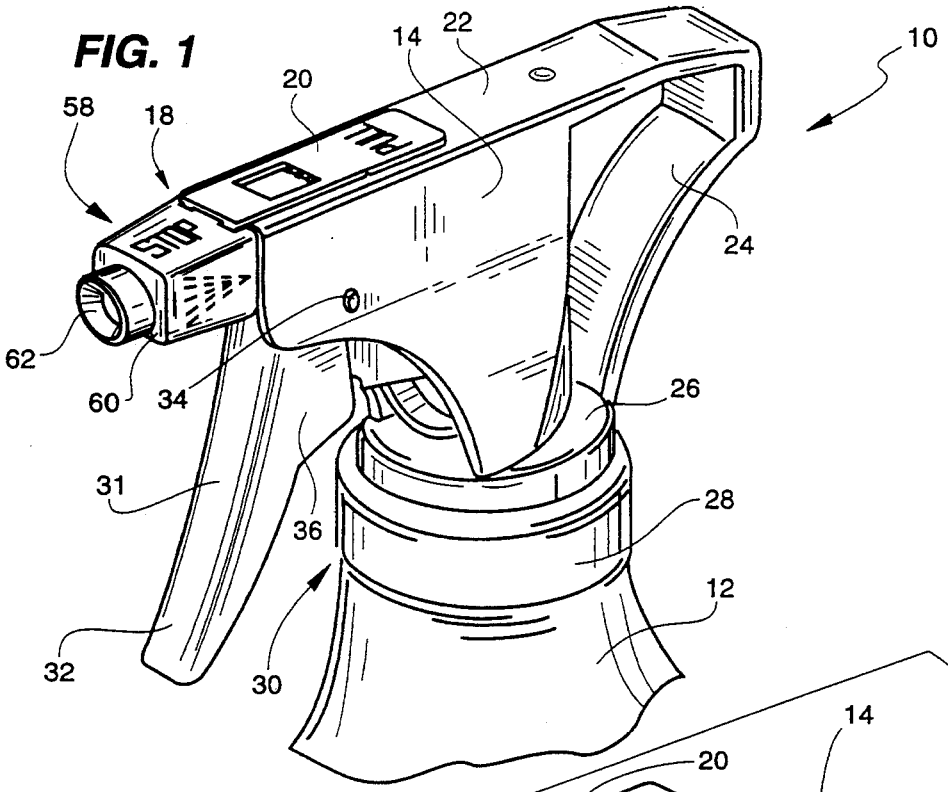
FIG. 1 is a perspective view of a trigger sprayer constructed according to the teachings of the present invention.

Referring now to the drawings in greater detail, there is illustrated in FIG. 1 a perspective view of an all synthetic/plastic trigger sprayer 10 coupled to a bottle 12.

Figure 2:
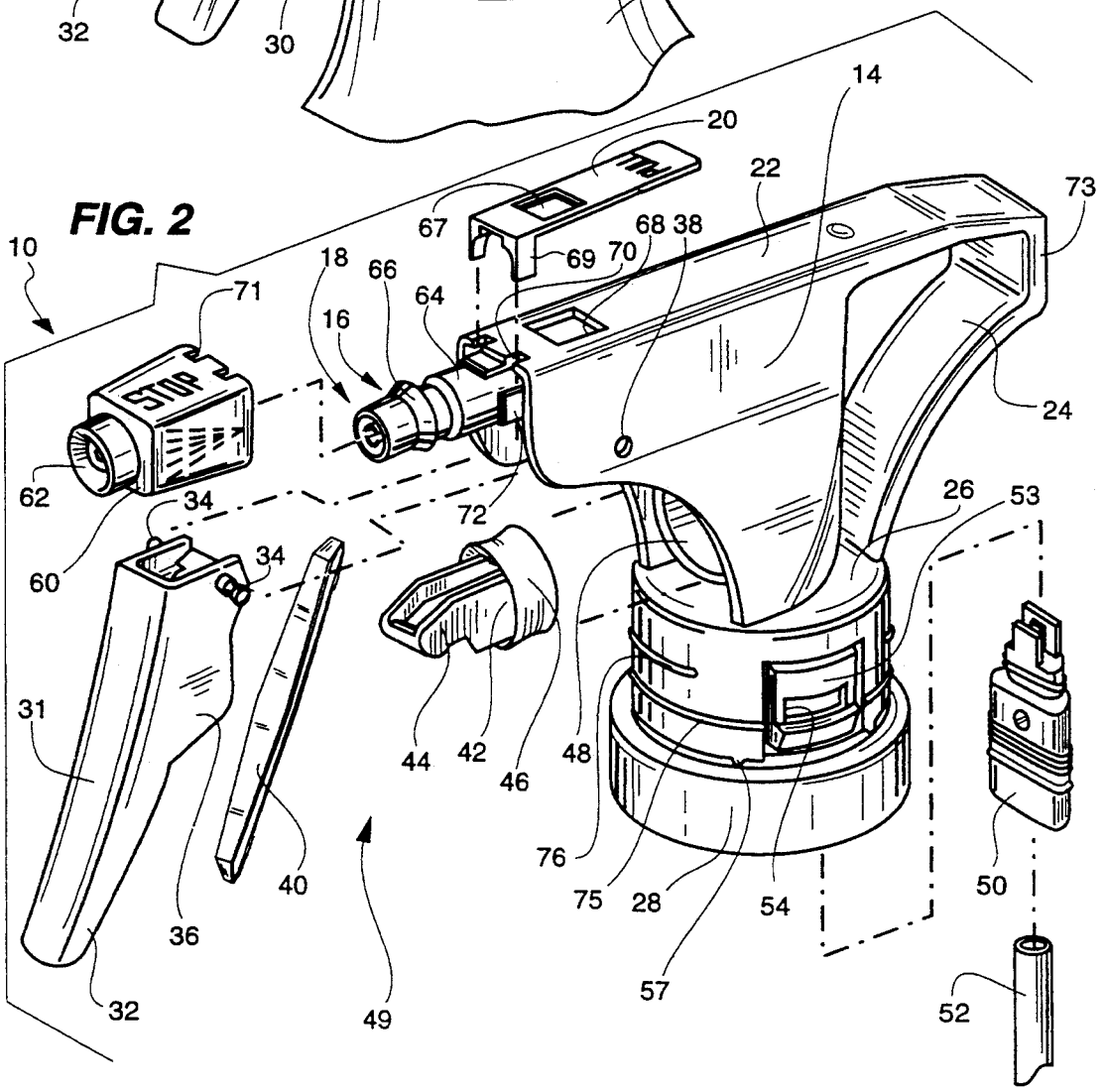
FIG. 2 is an exploded perspective view of the trigger sprayer shown in FIG. 1 and shows a locking ring prior to its detachment from a cylindrical base of the sprayer body.

An exploded perspective view of the parts of the trigger sprayer 10 is shown in more detail in FIG. 2.

The trigger sprayer 10 includes a body 14, a nose bushing 16 at a discharge end 18 of the body 14, a nozzle tamper proof pull away piece 20, a top portion 22 and a hand gripping formation 24 extending rearwardly from the top portion 22 of the body 14 and then downwardly to a cylindrical base 26 of the body 14. The base 26 is held by a locking ring 28 to a neck 30 of the bottle 12.

A trigger 32 having a front side 31 is pivotally mounted to the body 14 by having two cylindrical pins 34, molded on the top end of two opposed side walls 36 of the trigger 32, inserted into two corresponding holes 38 in the body 14 of the trigger sprayer 10.

As shown in FIG. 2, a plastic spring assembly 40 is placed between the body 14 and the trigger 32 to urge the trigger 32 always back into its home position. Coupled to the trigger 32 is a piston 42 having an outer piston rod 44 which connects with the trigger 32 and an inner cylindrical end 46 which is received in a cylindrical opening 48 in the body 14 for the purpose of varying the volume in a pumping chamber defined in the opening 48.

The trigger 32, the spring assembly 40, the piston 42 and the cylindrical opening 48 form and define primary components of a pumping mechanism 49.

A valve intake stem 50 is received into the bottom of the cylindrical base 26 and has a dip tube 52 releasably fixed thereto and depending therefrom for insertion into the bottle 12.

A safe and child resistant sprayer/bottle connection is provided and includes locking tabs 53 with lug receiving openings 54 formed in the cylindrical side wall of the cylindrical base 26 and locking lugs on the bottle neck 30 and locked in place by the locking ring 28.

When the molded sprayer body is removed from a mold, the locking ring 28, connected to the cylindrical base 26 of the body 14 by six links, points, fillets or webs 57 which are necessary for molding the locking ring 28 together with the body 14, is broken away from the cylindrical base 26 by breaking the fillets 57 and moved upwardly on the base 26. During assembly of the parts of the trigger sprayer 10, the locking ring 28 is moved downwardly over the cylindrical base 26.

A nozzle assembly 58 is provided and includes a rotatable nozzle cap 60 having a forwardly extending cylindrical extension 62. The nozzle cap 60 is mounted on the nose bushing 16 extending from a cylindrical portion 64 of the body 14 and includes an annular band 66 for holding the nozzle cap 60.

Three different positions of the nozzle cap 60, a STOP position, a SPRAY position, and a STREAM position are provided.

When the nozzle assembly 58 is mounted to the body 14, a mounting block 67 of the piece 20 is snap fittingly received through an opening 68 in the top portion 22. At the same time, fork arms 69 of the piece 20 extend through notches 70 in the top portion 22 and/or notches 71 in the top wall of the cap 60 between one of two flexible locking legs or prongs 72 and the cylindrical portion 64 for securing the nozzle cap 60 in its STOP position, thereby ensuring a tamper proof and child resistant locking of the trigger sprayer nozzle assembly 58 to the body 14.

The nozzle assembly 58 is mounted on the discharge end 18 of trigger sprayer 10, as described above. The top portion 22 of the body 14 extends rearwardly to a rear end 73 of the hand gripping formation 24 and then slants forwardly and downwardly from the rear end 73 to the cylindrical base 26.

The six contact fillets or webs 57 are uniformly distributed around the lower end of the cylindrical base 26 and are initially integral with the locking ring 28. During the molding process, the contact fillets or webs 57 are broken and the locking ring 28 is moved upwardly relative to the cylindrical base 26. Later, when the locking ring 28 is moved downwardly on the base 26, an annular groove 74 within the locking ring 28 snap-fittingly mates with an annular rib 75 on the base 26. The upper position of the locking ring 28 is the pre-application-to-a-bottle position and the locking ring 28 is held in this position by frictional engagement of the inner wall of the locking ring 28 with the rib segments 76 provided on the outer cylindrical wall of the cylindrical base 26. The upper, partially annular rib segments 76 on the outer cylindrical wall of the cylindrical base 26 locate and to some extent limit upward movement of the locking ring 28.

Figure 3:
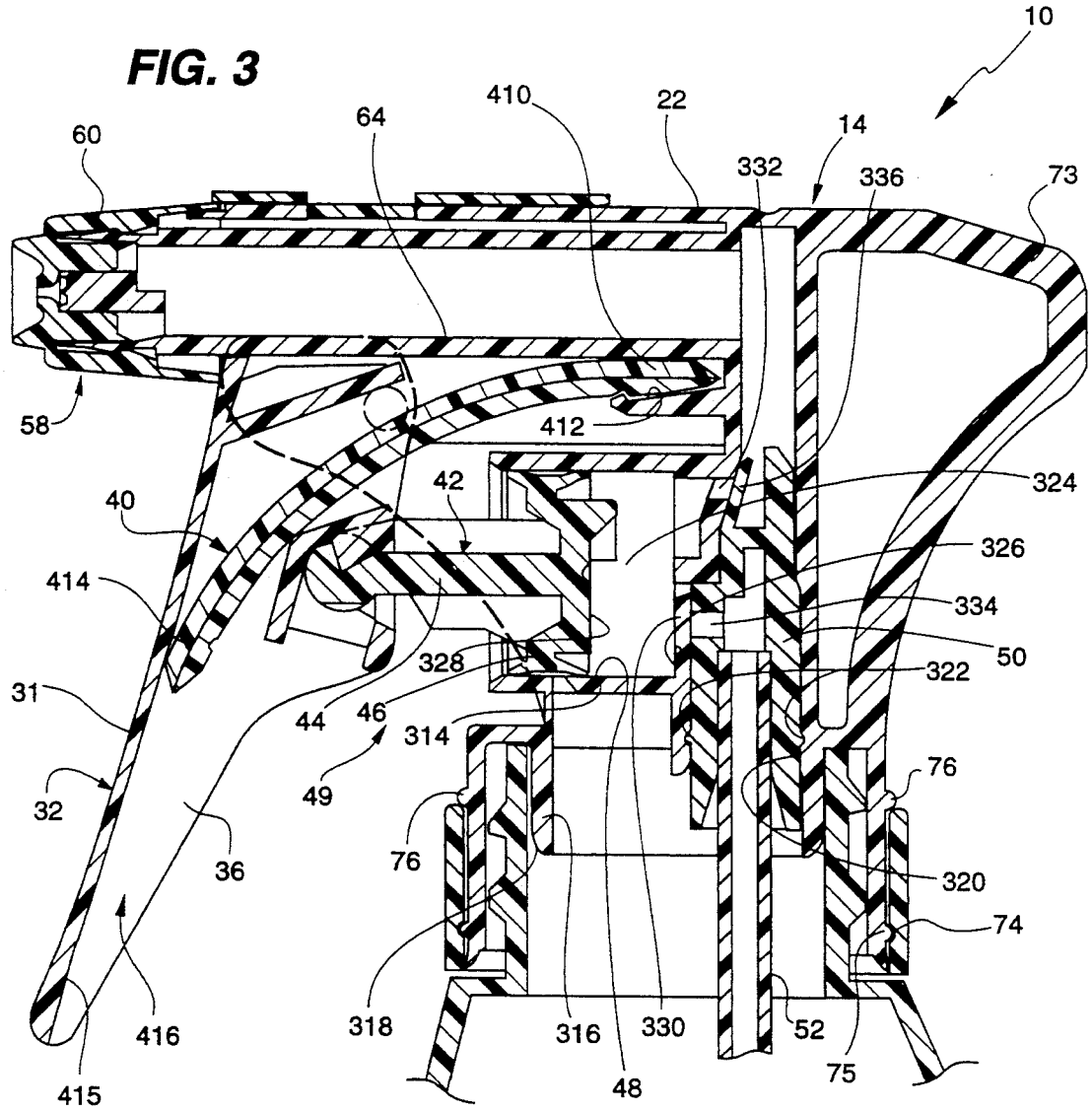
FIG. 3 is a vertical sectional view of the trigger sprayer in its at rest position where a spring between a trigger and the sprayer body biases the trigger and a piston rod coupled thereto to the most outward position.

As shown in FIG. 3, molded within the cylindrical base 26 to a top wall 314 of the cylindrical base 26 is a small diameter seal ring 316. The seal ring 316 is designed to seal against the inner diameter of the bottle neck 30. The seal ring 316 has a bevelled end 318 at its lower side to facilitate insertion of the bottle neck 30 into the base 26 and around the seal ring 316.

Within the inner area of seal ring 316 is an opening 320, having a shape according to the shape of the intake stem 50 which is generally oval in cross-section. The intake stem 50 is press-fitted into the opening 320 until ridges 322 on the intake stem 50 snap into mating mounting grooves on the inner surface of the wall of the opening 320. In this way, an air tight seal is provided. The diptube 52 is releasably fixed in the center of the intake stem 50. The length of the diptube 52 depends on the size of the bottle 12. However, it is recommended that the diptube 52 should extend to the bottom of the bottle 12 but shouldn't touch it.

The cylindrical opening 48 is located inside the body 14 of the trigger sprayer 10. The piston cylindrical end 46 fits tightly into the cylindrical opening 48 to create a pumping chamber 324 having a variable volume between a fixed back wall 326 of the cylindrical opening 48 and a rearwardly facing wall 328 of the piston cylindrical end 46. The fixed wall 326 of the pumping chamber 324 has an inlet flap valve 330 situated in the lower part thereof and an opening 332 in the upper part thereof. An orifice 334 through a wall of the intake stem 50 is located to mate or register with the inlet flap valve 330 and to establish an inlet passageway. The inlet passageway is provided by the hollow diptube 52, the intake stem 50 and the orifice 334.

The opening 332 is located to mate or register with an outlet flap valve 336 on the top side of intake stem 50. Inlet flap valve 330 and outlet flap valve 336 control the fluid flow into and out of pumping chamber 324.

The trigger 32 is pivotally mounted on the body 14 of the trigger sprayer 10 by inserting the two laterally extending pins 34 on the upper part of the trigger 32 into the two corresponding holes 38 in the body 14.

Figure 4:
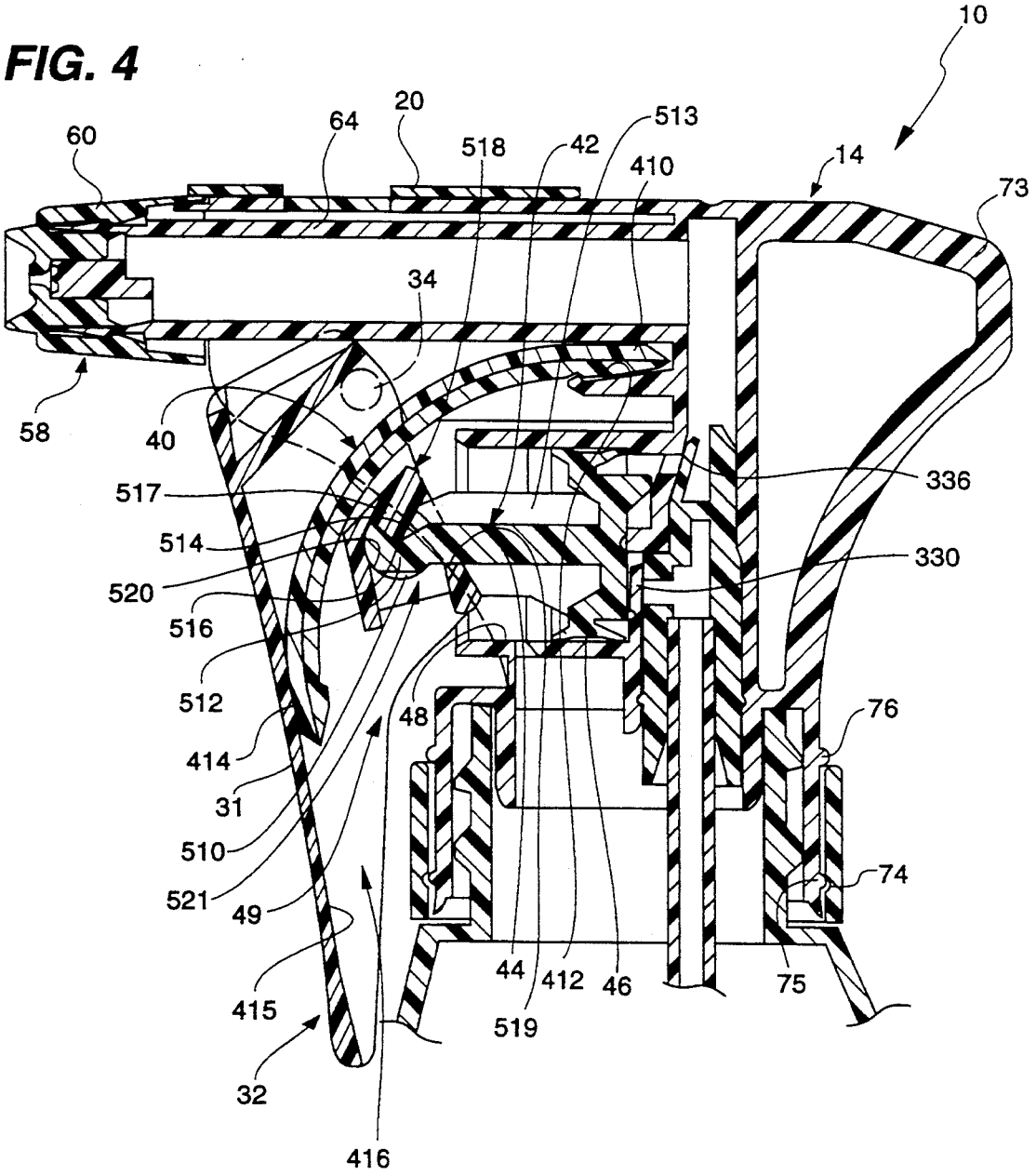
FIG. 4 is a vertical sectional view of the trigger sprayer similar to the view shown in FIG. 1 but showing the trigger fully depressed.

As shown in FIG. 4, the plastic spring assembly 40 has a flat tapered end 410 press-fitted into a recess 412 in the body 14 located underneath an inner end of the cylindrical portion 64 of the body 14. Another end 414 of the plastic spring assembly 40 is placed in a trough-like space 416 in the back side of the trigger 32 against a back wall 415. The plastic spring assembly 40 is bent and remains under stress to urge the trigger 32 always back into its home position.

An outer end 510 of the piston rod 44 has a transversely located cylinder 512. The cylinder 512 is located transversely to the longitudinal axis of the piston rod 44 between legs 513 and has an axially extending V in cross section slot 514 in the middle thereof for receiving a pivot edge 516 of a hook member 517 extending between the sides 36 of the trigger 32. The hook member 517 is part of a bearing formation 518 which is provided on the backside of trigger 32 between the sides 36 and which has an opening 519 through which the outer end 510 is received. The cylinder 512 engages in the bearing formation 518 of the trigger 32 and the sides of the V shaped slot 514 act as (or form) stops to limit the rotational freedom of the connected parts. The bearing formation 518, in combination with the V shaped slot 514, establish a movable trigger 32—piston 42 connection with limited, but sufficient, rotational freedom. This enables the piston 42 to be moved within the pumping chamber 324 while being pivotally connected to trigger 32 in a simple and efficient manner.

The bearing formation 518 includes two rounded bearing seating surfaces 520 adjacent the inner side of each side 36 of the trigger 32 and between one side 36 of the trigger 32 and the hook member 517 at the top of the opening 519 and between one side 36 and a slot 521 on the bottom of the opening 519. The cylindrical ends of the cylinder 512 seat and rotate on these bearing surfaces 520.

Figure 5:
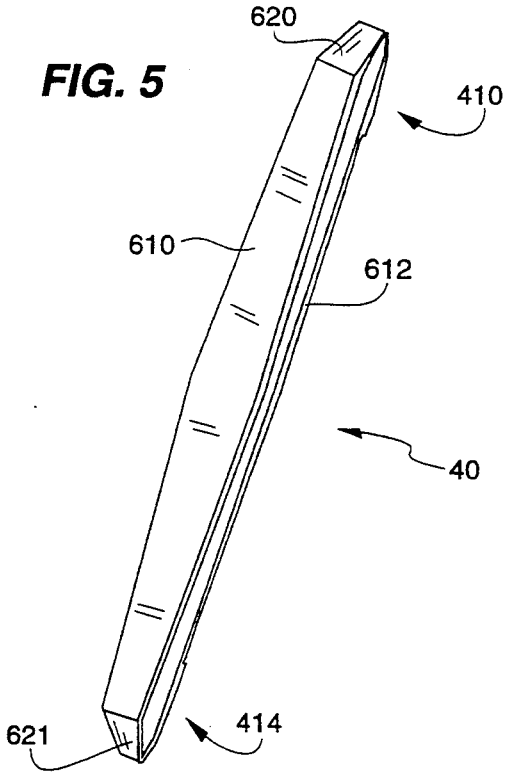
FIG. 5 is perspective view of a non-metal trigger sprayer spring assembly of the trigger sprayer shown in FIG. 1.
Figure 6:
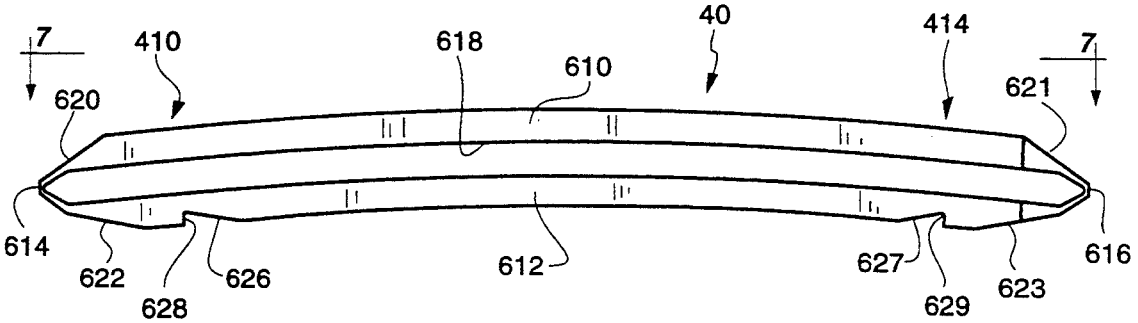
FIG. 6 is a side view of the spring assembly shown in FIG. 5.
Figure 7:
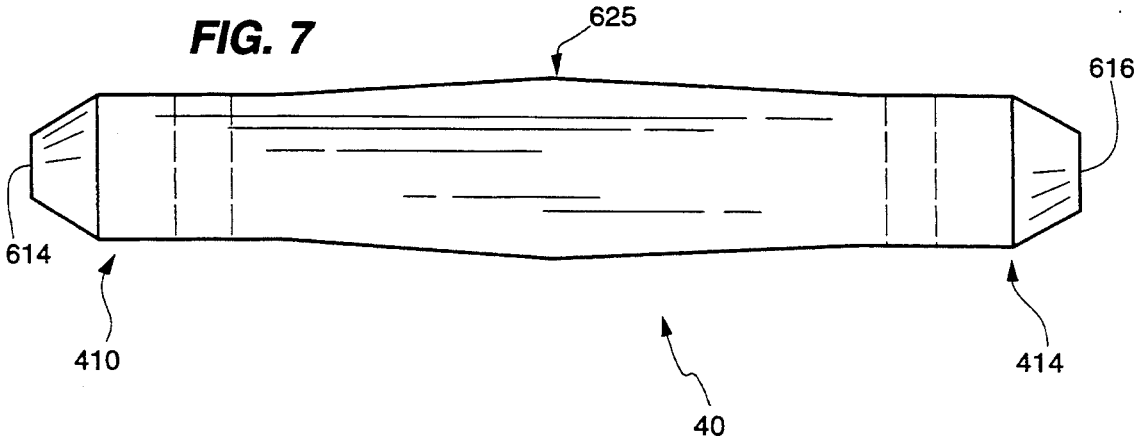
FIG. 7 is a top plan view of the spring assembly shown in FIG. 5.

Referring now to FIGS. 5, 6 and 7, the spring assembly 40 includes two leaf springs 610 and 612 which are connected together at each end by a webbing 614 or 616. As shown in FIG. 6, the two springs 610, 612 are bowed slightly to form an upper bowed spring 610 and a lower bowed spring 612. Each of these elongate springs 610, 612 are molded integral to each other and then a separation or split 618 between them is formed by a splitting process or cutting process. Alternatively, the spring assembly 40 can be a one piece molding comprising two blade springs connected together at each end. Further, as shown, each spring 610 and 612 is beveled at its ends as indicated by reference numerals 620 and 621 for spring 610 adjacent to the respective webbing 614 or 616. Likewise the lower elongate leaf spring 612 is beveled at 622 and 623 to the hinge or webbing 614 or 616 as shown.

Also, as best shown in FIG. 7, the end portions of each spring 610, 612 are tapered toward the webbing 614 or 616 and each spring 610, 612, is wider in a middle portion indicated by reference numeral 625.

The lower elongate leaf spring 612 has a notch 626, 627 formed at each end thereof to define a shoulder 628 or 629.

The spring assembly 40 with the ends of the springs 610 and 612 formed in the manner described above define the mirror-image ends 410 and 414, each of which is configured to fit into the recess 412 with the shoulder 628 or 629 being adapted to engage or hook with a shoulder adjacent the lower outer end of the recess 412 as shown in FIGS. 3 and 4.

The leaf springs 610, 612 are made of glass fiber reinforced plastic material such as a mixture of polypropylene and polyamide (nylon) plus 30% by weight glass fibers.

Figure 8:
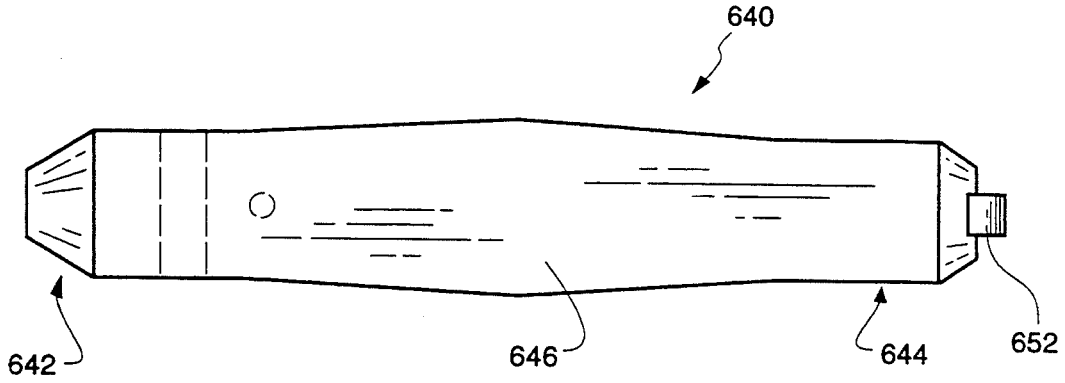
FIG. 8 is a top plan view of another embodiment of the spring assembly constructed according to the teachings of the present invention.
Figure 9:
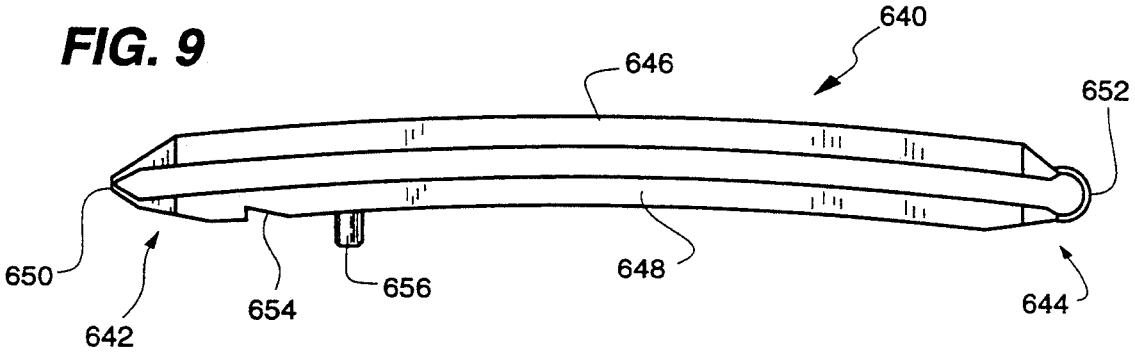
FIG. 9 is a side view of the spring assembly shown in FIG. 8.
Figure 10:
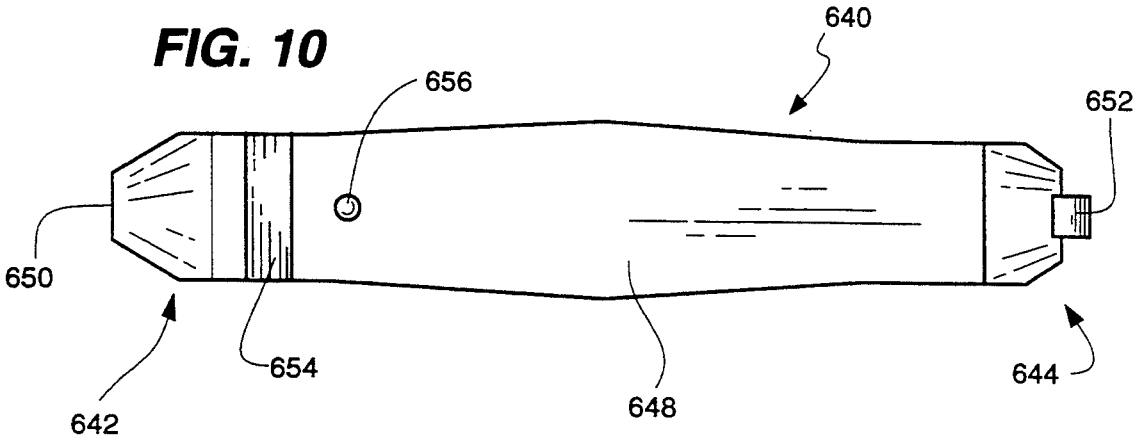
FIG. 10 is a bottom plan view of the spring assembly shown in FIG. 8.

Another embodiment of a spring assembly 640 constructed according to the teachings of the present invention is shown in FIGS. 8, 9 and 10. The spring assembly 640 has opposite ends 642 and 644, only one of which, the end 642 is adapted to be received in the recess 412. The spring assembly 640 includes an upper or elongate blade or leaf spring 646 and a lower elongate blade or leaf spring 648.

The ends 642 and 644 of the leaf springs 646 and 648 of the spring assembly 640 are beveled and tapered as in the spring assembly 40 shown in FIGS. 5–7. At the end 642, which is received in the recess 412, a hinge or web connection 650 is provided between the leaf springs 646 and 648. However, at the other end 644 the leaf springs 646 and 648 are connected by a cylindrical loop 652. The loop 652 is compressed when the trigger 32 is pushed against the outer surface of the blade leaf spring 646 adjacent the end 644 of the spring assembly 640.

As best shown in FIGS. 9 and 10, the lower leaf spring 648 has only one notch 654 on the outer surface thereof adjacent the end 642. Also, spaced inwardly of the notch and extending downwardly from the outer surface of the blade 648 is a small post 656 which serves to limit inward movement of the spring assembly into the recess 412 and to limit downward movement of the spring assembly 640 in use.

As shown in FIGS. 3 and 4, the spring assembly 40 or 640 is received between the bearing formation 518 and the back side 415 of the front wall 31 of the trigger 32 with the end 410 or 642 received in the recess 412 and the outer surface of the upper blade 610 or 646 bearing against the inner wall surface 415 of the front wall 31 of the trigger 32 in the trough area 416.

In use, the spring action is obtained by positioning the end 410 or 642 in the recess 412, by positioning the spring assembly 40 or 640 in the trough area 416 and between the bearing formation 518 and the back side 415 of the front wall 31 of the trigger 32, and by the sliding action of the outer surface of the blade 610 or 646 adjacent end 414 or 644 against the back side 415 of the front wall 31 of the trigger 32.

From the foregoing description it will be apparent that the plastic spring assembly 40 of the trigger sprayer 10 of the present invention has a number of advantages some of which have been described above and others of which are inherent in the invention. Also, modifications can be made to the plastic spring assembly 40 and the trigger sprayer 10 without departing from the teachings of the present invention. Accordingly, the scope of the invention is only to be limited as necessitated by the accompanying claims.

We claim:

1. A trigger operated pumping mechanism for a fluid dispensing device, said pumping mechanism comprising:

a body extending rearwardly from a discharge end of the fluid dispensing device toward a hand gripping formation of the fluid dispensing device;

said body having a hollow cylinder therein extending to a rear wall;

a piston received in said cylinder;

a trigger movably mounted to said body and having a front side and a back side, and being coupled to said piston; and biasing means for biasing said trigger away from said body to bias said piston coupled to said trigger out of said cylinder, said biasing means including non-metal, noncoiled, elongate spring means having opposite ends and being positioned between said body and said trigger; and, said spring means extending rearwardly from said trigger toward the hand gripping formation and having one end of said spring means positioned adjacent to and acting against said trigger the said other end of said spring means being positioned rearwardly of said trigger adjacent said body at a location which is closer to said rear wall of said cylinder than to said trigger.

2. The pumping mechanism of claim 1 wherein said biasing spring means includes at least one elongate flat spring made of glass fiber reinforced plastic.

3. The pumping mechanism of claim 1 wherein said biasing spring means is a spring leaf assembly including two elongate leaf springs.

4. The pumping mechanism of claim 3 wherein said leaf springs are connected together at each end.

5. The pumping mechanism of claim 1 wherein said body has a recess above said cylinder for receiving the other end of said spring means; said trigger back side has a back wall; and said spring means has a flat surface adjacent said one end of said spring means for slidably engaging said back wall of said trigger and the other end of said spring means having a shape configured to be received in said recess.

* * * * *